US005103735A

United States Patent [19]

Kaste et al.

[11] Patent Number: 5,103,735

[45] Date of Patent: Apr. 14, 1992

[54] SPLINED SABOT

[75] Inventors: Robert P. Kaste, North East; Bruce P. Burns, Churchville; Stephen A. Wilkerson, Sykesville, all of Md.; Peter Plostins, Bellerose, N.Y.

[73] Assignee: The United States of America as represented by the Secretary of the Army, Washington, D.C.

[21] Appl. No.: 718,045

[22] Filed: Jun. 20, 1991

[51] Int. Cl.[5] ..... F42B 14/06

[52] U.S. Cl. ..... 102/521

[58] Field of Search ..... 102/520–523

[56] References Cited

U.S. PATENT DOCUMENTS

| | | | |
|---|---|---|---|
| 4,284,008 | 8/1981 | Kirkendall et al. | 102/521 |
| 4,326,464 | 4/1982 | Price | 102/523 |
| 4,608,927 | 9/1986 | Romer et al. | 102/521 |
| 4,800,816 | 1/1989 | Meyer | 102/523 |

FOREIGN PATENT DOCUMENTS

| | | | |
|---|---|---|---|
| 158828 | 10/1985 | European Pat. Off. | 102/520 |
| 3314749 | 10/1984 | Fed. Rep. of Germany . | |
| 3704027 | 8/1988 | Fed. Rep. of Germany . | |

*Primary Examiner*—Harold J. Tudor

*Attorney, Agent, or Firm*—Saul Elbaum; Jason M. Shapiro

[57] ABSTRACT

An improved segmented doubled ramp sabot for launching a sub-caliber projectile, comprising a plurality of longitudinal ribs disposed on the forward and aft ramp sections of the sabot, and a plurality of longitudinal ribs disposed between an obturating band seat and a conical borerider. The combined cross sectional area of the double ramp segments, together with the combined cross sectional area of the ribs, are such that the sum of these areas is approximately equal to the cross sectional area of a double ramp sabot representative of prior art. As a result, axial stiffness is unaffected, and uniform shear traction forces between the sabot and projectile are maintained. In addition, the transverse bending stiffness of the sabot is improved, thereby reducing in-bore vibration and shot dispersion while allowing maximum energy transfer to the projectile. Use of a stiffer material for the ribs further improves transverse bending stiffness and performance.

4 Claims, 3 Drawing Sheets

SPLINED SABOT

GOVERNMENTAL INTEREST

The invention described herein may be manufactured, used and licensed by or for the U.S. Government for governmental purposes without the payment to us of any royalties thereon.

BACKGROUND OF THE INVENTION

A sabot is used to propel a subcaliber projectile at high velocity from a gun barrel. Its function is to increase the effective area against which the propellant gas pressure may act to propel the projectile. In modern projectile designs, particularly those in the armor piercing class, the sabot also provides significant structural support to the sub-projectile as it is accelerated through the gun barrel. It is also desirable for a sabot to be light in weight since energy which is required to propel the sabot is not imparted to the sub-projectile.

Prior art sabot designs have attempted to provide both structural support and minimum weight. For example, the sabot of Kirkendall et al., U.S. Pat. No. 4,284,008, teaches a double ramp design with a centrally positioned obturating band seat to eliminate the necessity for an excessively heavy boreriding support, like those used in prior art saddle back designs such as that of Luther et al., U.S. Pat. No. 3,981,246. In addition, by varying the axial stiffness of the sabot along its length, the double ramp design creates a more or less uniform axial shear stress at the sabot-projectile interface which maximizes load transfer between the sabot and the projectile.

Longitudinal grooves were used by Price, U.S. Pat. No. 4,326,464, to reduce the weight of a saddle back sabot while maintaining structural integrity and spatial position of the forward and aft boreriders. Similarly, Kraft, Foreign Patent No. DE 3704-027-A, teaches a reduced diameter saddle back sabot with lengthwise ribs between the annular guidance zones, or boreriders, to reduce the overall weight of the sabot without impairing its axial stiffness. However, both of these saddle back sabot designs may result in a decrease of transverse, or bending stiffness, and Price's invention may also suffer from decreased axial stiffness.

Romer, U.S. Pat. No. 4,608,927 (Foreign Patent No. DE 3314-749-A), teaches replacement of the front borerider in a double ramp sabot with fins to reduce overall weight. While maintaining proper axial stiffness to produce a uniform transfer of load, this design may actually impair overall transverse stiffness since a double ramp sabot is subject to bending of its tapered ends.

Romer also teaches the use of a synthetic material for all or part of the component fins. Sabot segments are generally fabricated from stiff metals, or fiber reinforced plastics (see Puckett, U.S. Pat. No. 4,958,571). Unreinforced synthetic materials tend to be more compliant than commonly used metals or composites, so it appears that Romer does not intend to teach the use of stiffer materials for its fins. In addition, because Romer's fins are not structural it is unlikely that a stiffer material would have been chosen.

SUMMARY OF THE INVENTION

The present invention relates to a segmented double ramp discarding type sabot for use with a subcaliber projectile. A plurality of double ramp sabot segments are provided with tapered forward and aft ends, a centrally located obturating band seat, and front borerider. The segments are further provided with a plurality of longitudinal ribs disposed on aft sections of the sabot segments, and optionally on the forward sections. In addition, a plurality of longitudinal ribs are disposed between the obturating band seat and the borerider. The combined cross sectional area of the segments, and the combined cross sectional area of the ribs, are such that the sum of these areas is approximately equal to the cross sectional area of a double ramp sabot as taught by prior art, whereby the transverse bending stiffness of the prior art sabot may be improved without an increase in weight, thereby controlling inbore vibration and improving shot dispersion.

The present invention additionally provides for longitudinal ribs to be fabricated of a stiffer material than the sabot segments, the obturating band seat, and the borerider, whereby the transverse bending stiffness of the sabot can be further improved in those regions where the bending stresses are greatest.

The present invention further provides for longitudinal ribs disposed aft of said obturating band seat, which are further disposed along segment interfaces to assist in the discard of the sabot by means of aerodynamic lift after the projectile and sabot exit the gun bore and the sabot segments have begun to separate.

BRIEF DESCRIPTION OF THE DRAWINGS

The preferred embodiments of the present invention will be described with reference to the accompanying drawings.

DESCRIPTION OF THE PREFERRED EMBODIMENTS

Figure 1:
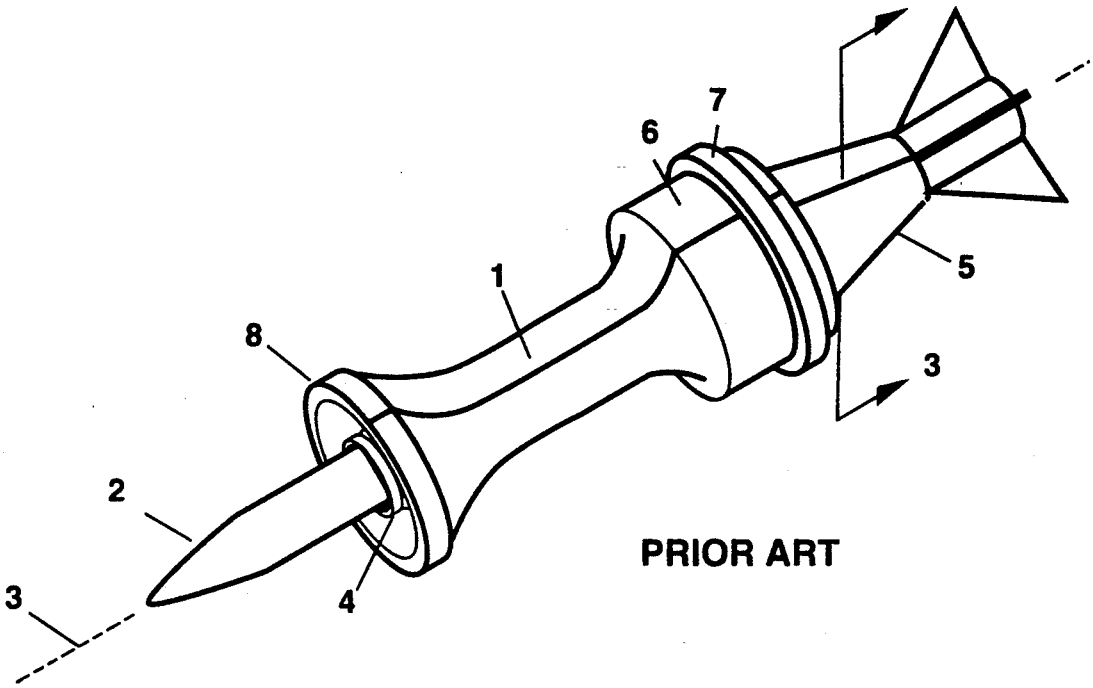
FIG. 1 is an isometric view of a prior art segmented double ramp discarding sabot supporting a subcaliber fin-stabilized projectile.

FIG. 1 illustrates a prior art double ramp segmented discarding sabot, having a plurality of segments 1 which hold the subcaliber projectile 2 parallel to and axially aligned with the longitudinal axis 3 of the gun bore. The sabot segments 1 have a forward tapered ramp surface 4 and an aft tapered ramp surface 5 to facilitate a nearly uniform shear loading at the projectile/sabot interface. Intermediate the forward ramp 4 and the aft ramp 5 is a cylindrical obturating band seat 6 which is circumferentially grooved to accept an annularly shaped obturating band 7. The obturating band 7 is typically made of a plastic material such as nylon, and force fit over the obturating band seat 6 and into the aforementioned groove to prevent gas leakage between the gun tube and the obturating band seat 6. Forward of the obturating band seat 6 and extending over the forward ramp 4 is a borerider 8 formed from a conical shell which provides initial guidance for the projectile 2 while in-bore. After the projectile 2 exits the gun bore, aerodynamic forces act upon the pocket formed by the conical borerider 8 causing the segments 1 to separate from the projectile 2, thereby enhancing discard.

Figure 2:
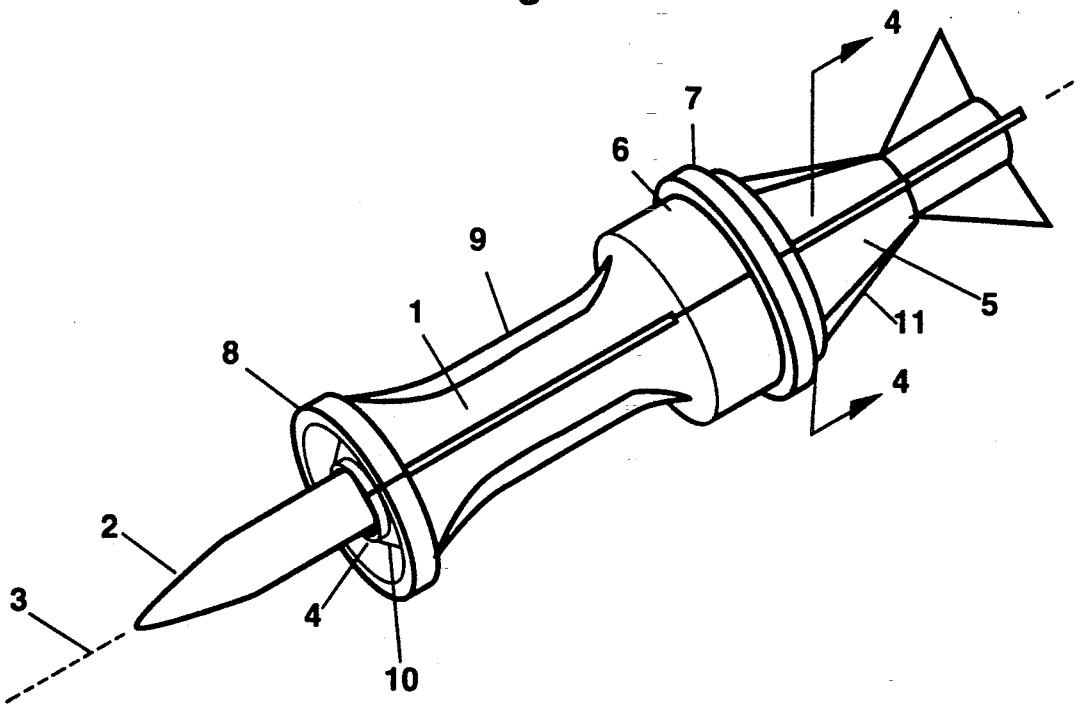
FIG. 2 is an isometric view of a segmented double ramp discarding sabot with ribs supporting a subcaliber fin-stabilized projectile.

In addition to the above features, the present invention as illustrated in FIG. 2 comprises three groups of continuous longitudinal ribs 9, 10, and 11, which are integrally connected to the sabot segments 1, and which have varying height and width along the longitudinal axis 3 of the sabot. The longitudinal ribs are arranged radially about the sabot segments and in at least three intersecting planes, the intersection of which coincides with the longitudinal axis of the sabot. The first set of longitudinal ribs 9 are disposed between the obturating band seat 6 and the conical borerider 8. The remaining sets of longitudinal ribs 10 and 11 are disposed on the forward ramp surface 4 and the aft ramp surface 5 of the sabot segments 1. The presence of longitudinal ribs in these locations results in greater transverse bending stiffness which in return reduces inbore transverse motion of the sabot and projectile.

The longitudinal ribs 9, 10, and 11, sabot segments 1, obturating band seat 6, and borerider 8, may be fabricated together or in component form from any high strength aluminum alloy such as 7075-T6. When fabricated as a single unit, it may be desirable to provide fillets at those places where the ribs 9, 10, and 11, meet the sabot segments 1, obturating band seat 6, and borerider 8. In addition, the longitudinal ribs 9, 10, and 11, may be fabricated in component form from materials which are stiffer than the aluminum alloy, for instance 18-8 stainless steel, to further improve transverse bending stiffness.

Figure 3:
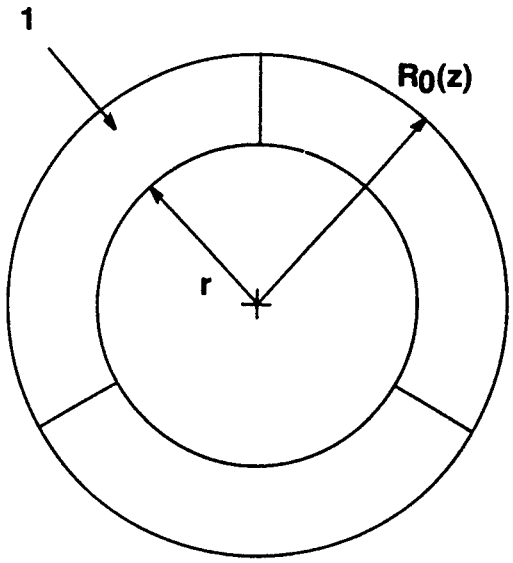
FIG. 3 is a cross-sectional view of a prior art segmented double ramp discarding sabot taken along line 3—3 of FIG. 1.
Figure 4:
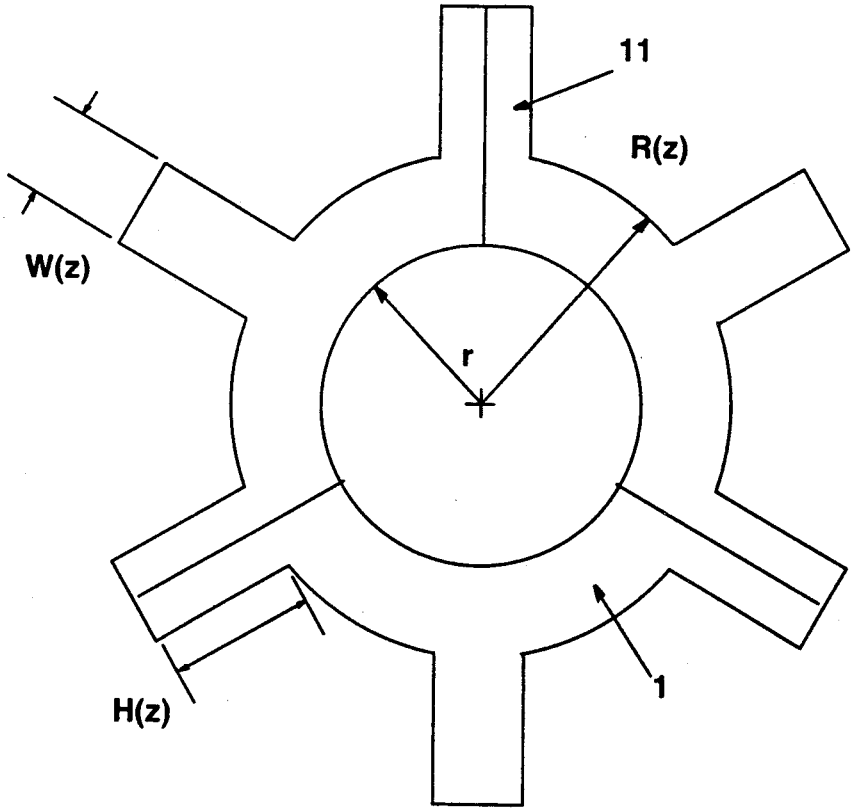
FIG. 4 is a cross-sectional view of a segmented double ramp discarding sabot with ribs taken along line 4—4 of FIG. 2.

In order to maintain the weight savings and axial stiffness of the double ramp sabot design, the present invention substitutes an equal area spline as illustrated in FIG. 4 for the cross section of the prior art double ramp sabot as illustrated in FIG. 3. As a result, the combined cross sectional area B(z) of the present invention's segments 1 at any point z along the longitudinal axis 3, as given by $$B(z)=\pi(R(z)^2-r^2)$$

where R(z) is the radius of each segment's outer surface and r is the radius of the inner surface, together with the combined cross sectional area C(z) of the present invention's ribs 9, 10, and 11 at the same point along the longitudinal axis, as given by $$C(z)=N(z)*w(z)*h(z)$$

where N(z) is the number of ribs, w(z) is the width of the ribs, and h(z) is their height, are such that $$B(z)+C(z)\approx\pi(R_0(z)^2-r^2)$$

where $R_0(z)$ is the radius of the prior art segment's outer surface and r is the inner radius of these segments. In addition, ribs 9, 10, and 11 should be such that the ratio of their height h(z) to their width w(z) at any point along the axis 3 does not exceed 10:1, to resist buckling due to axial loads.

Calculations performed using a height to width ratio of 3:1 for the ribs, and a segment radius R(z) that is 82% that of the prior art radius $R_0(z)$ demonstrates the effect of varying the number of ribs N(z) upon the bending moment of inertia $I_s$, and are summarized in the following table along with the prior art bending moment of inertia $I_0$:

| N(z) | 0 | 3 | 6 | 9 | 12 |
|---|---|---|---|---|---|
| $R(z)/R_0(z)$ | 1 | .82 | .82 | .82 | .82 |
| $I_S$ | .049 | .082 | .068 | .063 | .060 |
| $I_0$ | .049 | .049 | .049 | .049 | .049 |
| $I_S/I_0$ | 1 | 1.669 | 1.394 | 1.284 | 1.222 |

The effectiveness of the present invention was also investigated using a three-dimensional transient mechanical calculation that simulated the behavior of a projectile travelling down the bore of rifled and non-rifled gun tubes. The new design exhibited a lowering of critical stresses due to in-bore transverse motion, a reduction of the yaw and angular launch rates, and their variances by a factor of approximately two. This reduction of angular launch rates and variances will result in an improvement of shot dispersion.

As a further benefit, the placement of ribs 11 in the aft ramp section along segment interfaces as shown in FIG. 4 will provide aerodynamic lift to the segments 1 as they separate from the projectile 2 and enhance discard of the sabot.

Figure 5:
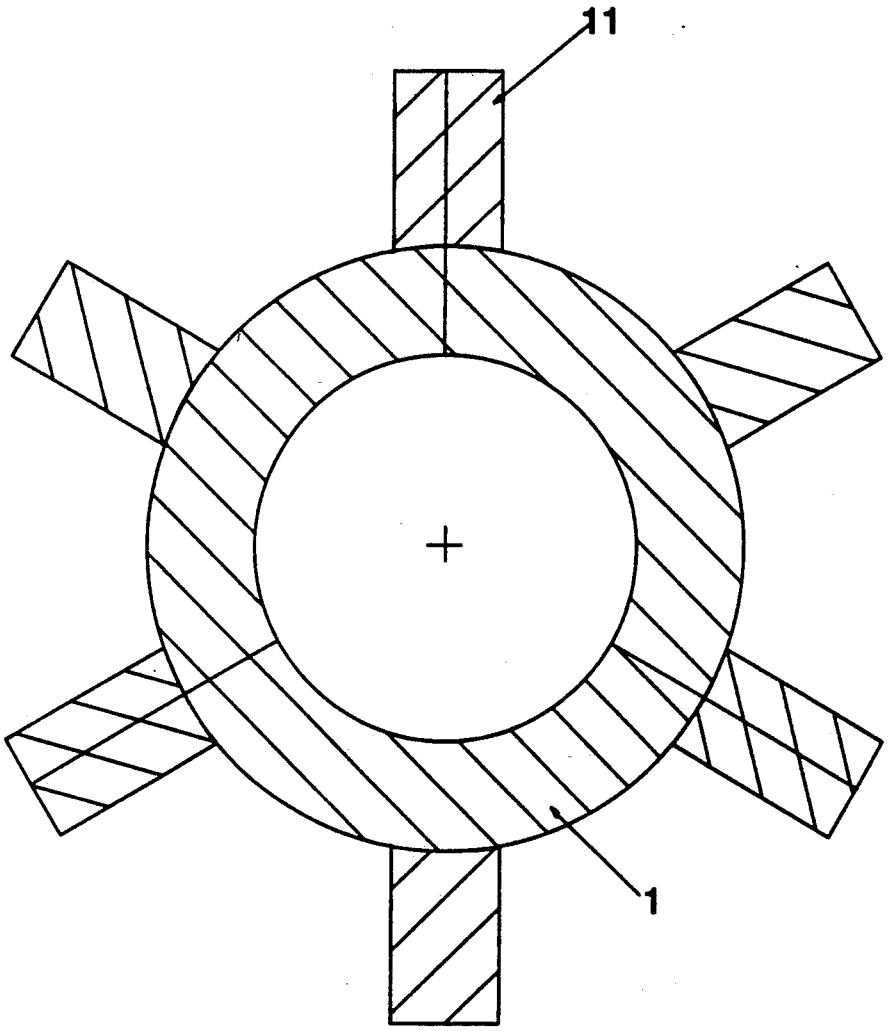
FIG. 5 is a cross-sectional view of a segmented double ramp discarding sabot, taken along line 4—4 of FIG. 2, further illustrating component ribs of a stiffer material than the sabot segments.

As mentioned previously and illustrated in FIG. 5 for the aft section, longitudinal ribs 9, 10, and 11, may be fabricated in component form from a material which is stiffer than that used in fabricating the double ramp segments 1. In this embodiment, the transverse bending stiffness of the sabot is further improved.

While there has been described and illustrated specific embodiments of the invention, it will be obvious that various changes, modifications and additions can be made herein without departing from the field of the invention which should be limited only by the scope of the appended claims.

We claim:

1. A segmented double ramp discarding type sabot for use with a subcaliber projectile, said sabot comprising:

a plurality of double ramp sabot segments provided with tapered forward and aft ends, an obturating band and band seat disposed between said ends, and a front borerider;

said segments further provided with a plurality of longitudinal ribs disposed on forward and aft ramped sections and between said obturating band seat and said borerider;

said longitudinal ribs being of a stiffer material than said sabot segments, said obturating band seat, and said borerider, whereby transverse bending stiffness of said sabot is improved.

2. A segmented double ramp discarding type sabot for use with a subcaliber projectile, said sabot comprising:

a plurality of double ramp sabot segments provided with tapered forward and aft ends, an obturating band and band seat disposed between said ends, and a front borerider;

said segments further provided with a plurality of longitudinal ribs disposed on forward and aft ramped sections and between said obturating band seat and said borerider;

said longitudinal ribs being of a stiffer material than said sabot segments, said obturating band seat, and said borerider, wherein said longitudinal ribs are substantially rectangular in cross section, having both height and width, and are such that their height is no more than ten times their width at any point along the longitudinal axis of said sabot.

3. A segmented double ramp discarding type sabot for use with a subcaliber projectile, said sabot comprising:

a plurality of double ramp sabot segments provided with tapered forward and aft ends, an obturating band and band seat disposed between said ends, and a front borerider;

said segments further provided with a plurality of longitudinal ribs disposed on forward and aft ramped sections and between said obturating band seat and said borerider;

wherein said longitudinal ribs are further disposed radially about said segments and in at least three intersecting planes, the line of intersection defining the longitudinal axis of said sabot, whereby the arrangement of said ribs increases bending resistance in all planes which contain said longitudinal axis.

4. A segmented double ramp discarding type sabot for use with a subcaliber projectile, said sabot comprising:

a plurality of double ramp sabot segments provided with tapered forward and aft ends, an obturating band and band seat disposed between said ends, and a front borerider;

said segments further provided with a plurality of longitudinal ribs disposed on forward and aft ramped sections and between said obturating band seat and said borerider;

wherein said longitudinal ribs are further disposed radially about said segments and in at least three intersecting planes, the intersection of which corresponds to the longitudinal axis of said sabot, said ribs also being substantially rectangular in cross section, having both height and width which vary along the longitudinal axis of the sabot, and having a height which is no more than ten times the width at any point.

* * * * *